US011613935B2

(12) United States Patent
Dux et al.

(10) Patent No.: US 11,613,935 B2
(45) Date of Patent: Mar. 28, 2023

(54) COUPLERS FOR CONNECTING A POWER SOURCE TO A DRILLING STRING

(71) Applicant: Vermeer Manufacturing Company, Pella, IA (US)

(72) Inventors: Darin Lyn Dux, Pella, IA (US); David Wayne Jahraus, Pella, IA (US)

(73) Assignee: VERMEER MANUFACTURING COMPANY, Pella, IA (US)

( * ) Notice: Subject to any disclaimer, the term of this patent is extended or adjusted under 35 U.S.C. 154(b) by 0 days.

(21) Appl. No.: 17/071,728

(22) Filed: Oct. 15, 2020

(65) Prior Publication Data

US 2021/0115739 A1 Apr. 22, 2021

Related U.S. Application Data

(60) Provisional application No. 62/916,516, filed on Oct. 17, 2019.

(51) Int. Cl.
*E21B 17/03* (2006.01)
*E21B 7/02* (2006.01)

(52) U.S. Cl.
CPC ..... *E21B 17/03* (2013.01); *E21B 7/02* (2013.01)

(58) Field of Classification Search
CPC ..... E21B 17/02; E21B 17/03
See application file for complete search history.

(56) References Cited

U.S. PATENT DOCUMENTS 2,893,276 A 5/1955 Quakenbush
3,194,330 A * 7/1965 Ware ..... E21B 17/07 175/321
3,360,285 A * 12/1967 Huckshold ..... F16L 37/1235 285/8
3,763,666 A * 10/1973 Tibussek ..... E21B 17/07 464/18
4,196,781 A * 4/1980 Cheek ..... E21B 7/04 175/321
4,232,751 A 11/1980 Trzeciak
4,378,057 A * 3/1983 O'Connell ..... E21B 21/12 175/215
4,622,022 A * 11/1986 Diffenderfer ..... B21C 3/00 464/162

(Continued)

OTHER PUBLICATIONS https://www.youtube.com/watch?v=N_LS6u0BkKY, "Ditch Witch Roto-Witch Attachment Operation", May 22, 2012.

(Continued)

*Primary Examiner* — Taras P Bemko
(74) *Attorney, Agent, or Firm* — Armstrong Teasdale LLP

(57) ABSTRACT

Couplers for connecting a power source to a drilling string are disclosed. The coupler may include an elongate assembly including a first portion and a second portion. The first portion and the second portion are configured to move relative to each other such that the coupler may be arranged in a retracted position, an extended position, and one or more intermediate positions. In the retracted position, the coupler may transmit a compressive force and/or a torque to the drilling string. In the extended position, the coupler may transmit a tensile force and/or a torque to the drilling string. In the intermediate positions, the first portion and the second portion are able to translate and rotate independently relative to each other.

11 Claims, 12 Drawing Sheets

(56) References Cited

U.S. PATENT DOCUMENTS

| | | | | |
|---|---|---|---|---|
| 5,168,944 | A * | 12/1992 | Andersson | E21B 17/0426 175/321 |
| 2008/0017420 | A1* | 1/2008 | Law | E21B 17/076 175/321 |
| 2018/0313157 | A1 | 11/2018 | Langenfeld et al. | |
| 2018/0313171 | A1 | 11/2018 | Vos et al. | |
| 2021/0078616 | A1* | 3/2021 | Wang | B61G 9/20 |

OTHER PUBLICATIONS https://www.youtube.com/watch?v=bUDkXgsgt_U&feature=youtu.be&t=468, "Ditch Witch RotoWitch Safety Video", Mar. 29, 2018.
https://mclaughlinunderground.com/moleing/moleing-rod-bits-reamers-accessories/, available before Oct. 17, 2019.

* cited by examiner

COUPLERS FOR CONNECTING A POWER SOURCE TO A DRILLING STRING

CROSS-REFERENCE TO RELATED APPLICATION

This application claims the benefit of U.S. Provisional Patent Application No. 62/916,516, filed Oct. 17, 2019, which is incorporated herein by reference in its entirety.

FIELD OF THE DISCLOSURE

The field of the disclosure relates to couplers for transmitting torques or forces to a drilling string and, more specifically, to a coupler of adjustable length including a retracted configuration for transmitting at least one of a compressive force and a torque and an extended configuration for transmitting at least one of a tensile force and a torque to a drilling string.

BACKGROUND

Horizontal drilling operations may be used to install utilities below obstacles which make trenching difficult or impractical (e.g., driveways, waterways, other utilities or the like). Such drilling operations may involve a power source such as a utility tractor or other boring machine that rotates a drilling string and drives the drilling string forward or backward (e.g., for back-reaming or pulling in utility product such as water, gas, electrical, fiberoptic or conduit for such products).

During the course of a drilling operation, the drilling string may be connected, disconnected, and or reconnected to the power source. Connecting the power source to the drilling string is a tedious and time consuming process, frequently requiring more than one operator to perform the connection. For example, a first operator may hold or support a portion of the drilling string while a second operator guides the power source forward toward the drilling string. In some instances, an operator may rotate the power source a small incremental amount in order to properly index the power source with the drilling string.

A need exists for a coupler that allows the power source to be connected to the drilling string without having to move the power source forward and/or without having to rotate the power source incrementally to index the power source with the drilling string.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to a coupler for connecting a power source to a drilling string. The coupler includes an elongate assembly having a first portion, a second portion, and a coupler axis passing through the first portion and the second portion. The first portion is configured to removeably connect to a power source. The second portion is configured to removeably connect to a drilling string. The first portion and the second portion are configured to move relative to each other along the coupler axis over a stroke length. The stroke length extends between a retracted position of the coupler in which the first portion and the second portion are constrained from moving toward each other along the coupler axis and wherein the coupler is able to transfer a compressive force and transmit torque from the first portion to the second portion and an extended position of the coupler in which the first portion and the second portion are constrained from moving away from each other along the coupler axis and wherein the coupler is able to transfer a tensile force and transmit torque from the first portion to the second portion. The coupler is moveable to one or more intermediate positions between the retracted position and the extended position. The first portion and the second portion are able to rotate independently relative to each other about the coupler axis in the one or more intermediate positions.

Yet another aspect of the present disclosure is directed to a coupler for transmitting torque and axial force. The coupler includes an inner shaft. The inner shaft includes an inner shaft torque segment having one or more inner shaft torque transferring surfaces. The inner shaft includes a drilling string connection member for connecting the inner shaft to a drilling string. The coupler includes an outer shaft. The outer shaft has at least a portion of the inner shaft received therein. The outer shaft includes a power source connection member for connecting the outer shaft to a power source. The outer shaft includes a first outer shaft torque segment having one or more outer shaft torque transferring surfaces. The outer shaft includes a second outer shaft torque segment having one or more outer shaft torque transferring surfaces. The first outer shaft torque segment is spaced from the second outer shaft torque segment along a coupler axis that passes through the inner shaft and the outer shaft. The inner and outer shafts are moveable relative to each other along the coupler axis to allow the one or more inner shaft torque transferring surfaces to selectively contact (1) the one or more outer shaft torque transferring surface of the first outer shaft torque segment or (2) the one or more outer shaft torque transferring surfaces of the second outer shaft torque segment.

Yet another aspect of the present disclosure is directed to a boring system for forming a bore hole. The boring system includes a self-propelled machine comprising a power source for generating axial force and torque and a rotational driver driven by the power source. The boring system includes a coupler for transmitting torque and axial force from the power source to a drilling string. The coupler is moveable between a retracted position of the coupler in which the coupler is able to transfer a compressive force and transmit torque from the rotational driver to the drilling string, an extended position of the coupler in which the coupler is able to transfer a tensile force and transmit torque from the rotational driver to the drilling string, and an intermediate position between the retracted position and the extended position. The coupler is prevented from transferring toque and axial force from the rotational driver to the drilling string in the intermediate position.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
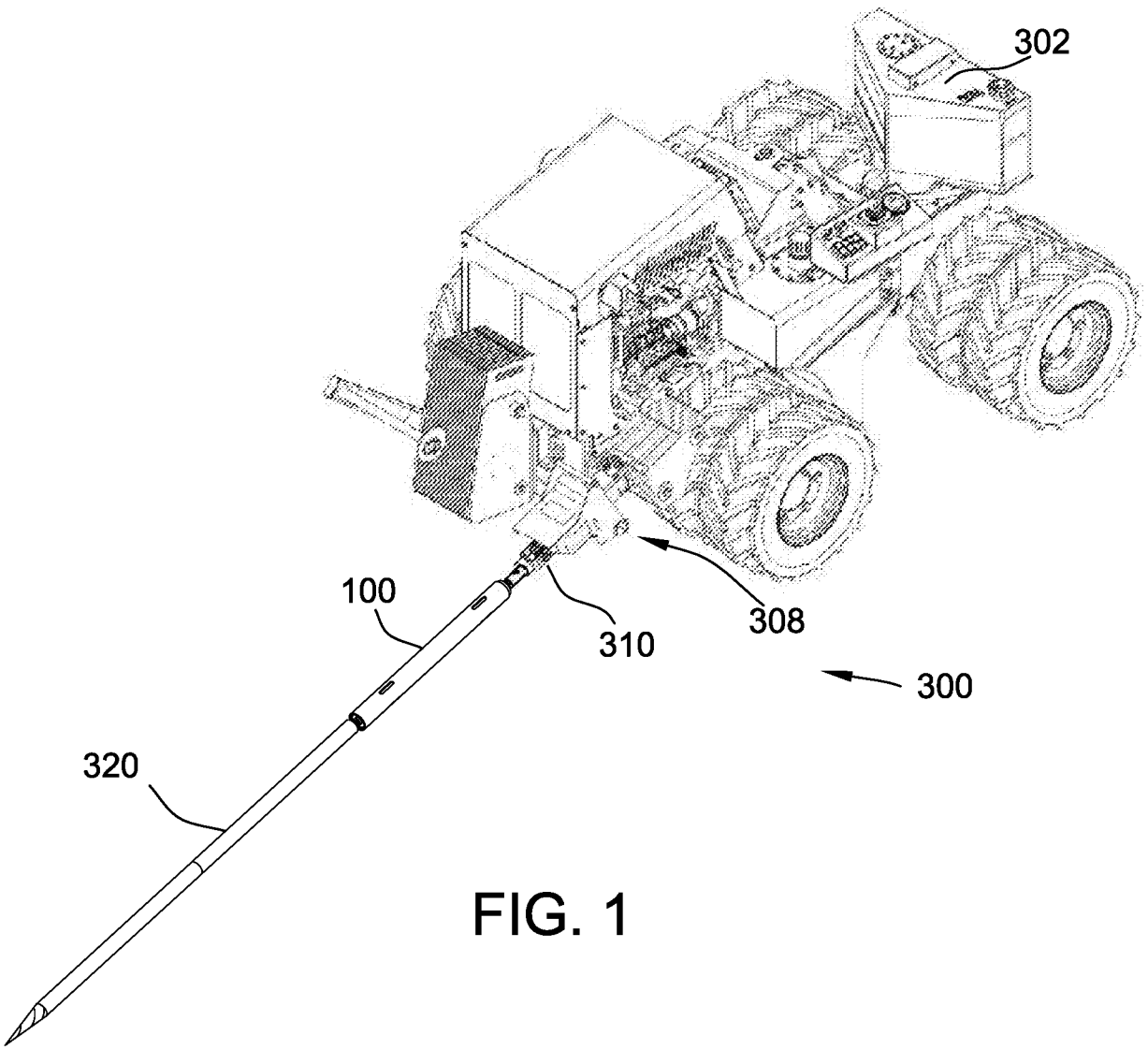
FIG. 1 is a perspective view of an example embodiment of a coupler connecting a self-propelled machine to a drilling string.

An example coupler 100 for use with a drilling string is shown in FIGS. 1-7. The coupler 100 may be a stand-alone device or the coupler 100 may be incorporated with other equipment. For example, the coupler may be integrated with a boring system 300 for forming a bore hole as shown in FIG. 1. The boring system 300 includes a self-propelled machine 302 and a coupler 100 used to transmit forces and torques to a drilling string 320. The self-propelled machine may include a power source 308 that drives a rotational driver 310. Rotations of the rotational driver 310 apply torques to the coupler 100. For example, the rotational driver 310 may be a drive shaft of a motor mounted to the self-propelled machine 302. The coupler 100 may be removeably connected to the power source 308 in cooperation with the self-propelled machine 302. The power source 308 may apply torque and forces to the coupler 100. The coupler 100 is also removeably coupled to the drilling string 320 such that torques and forces applied to coupler 100 are transmitted to the drilling string 320.

The drilling string 320 may generally include any suitable components for performing a drilling operation. For example, the drilling string 320 may include one or more drill rods connected together to form a "string" with a drilling tool connected to the drilling end of the string. Suitable drilling tools include a reamer, drill bit, and pull-back devices for pulling a utility product through the hole.

Figure 6:
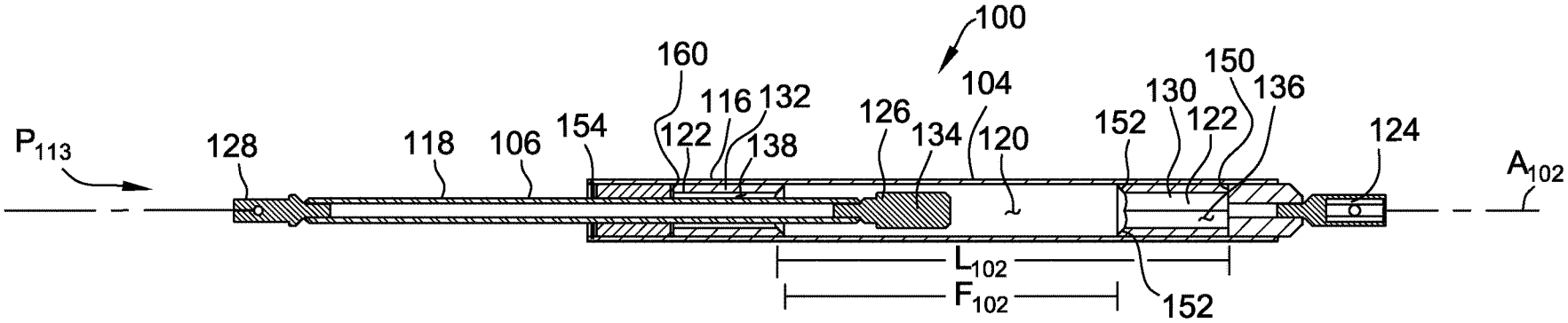
FIG. 6 is a cross-section front view of the coupler in an intermediate position.

As discussed further below, the coupler 100 is moveable between a retracted position $P_{112}$ (FIGS. 2 and 5), an extended position $P_{114}$ (FIGS. 4 and 7), and one or more intermediate positions $P_{113}$ (FIG. 6). In the retracted position $P_{112}$, the coupler 100 is able to transfer a compressive force and transmit a torque from the rotational driver 310 to the drilling string 320. In the extended position $P_{114}$, the coupler 100 is able to transfer a tensile force and transmit a torque from the rotational driver 310 to the drilling string 320. The one or more intermediate positions $P_{113}$ are between the retracted position $P_{112}$ and the extended position $P_{114}$. When the coupler 100 is in an intermediate position $P_{113}$, the coupler 100 is prevented from transferring torque and axial force from the rotational driver 310 to the drilling string 320.

Motions of the self-propelled machine 302 transmit either a compressive or a tensile force to the coupler 100. For example, the self-propelled machine 302 may be driven away from the drilling string 320 causing a tensile force to be applied to the coupler 100 or alternatively, the self-propelled machine 302 may be driven towards the drilling string 320 causing a compressive force to be applied to the coupler 100. In other example embodiments, the power source 308 may include a rail system or a conveyor system supported by the self-propelled machine 302 that applies a compressive force or tensile force to the coupler 100.

The boring system 300 may be used for a forward drilling operation or for a back-reaming operation. During the forward drilling operation, the self-propelled machine applies a compressive force to the coupler 100 while the rotational driver 310 applies a torque to the coupler 100. During the back-reaming drilling operation, the self-propelled machine applies a tensile force to the coupler 100 while the rotational driver 310 applies a torque to the coupler 100. During the forward drilling operation, the coupler 100 is in the retracted position $P_{112}$, such that the coupler 100 transmits compressive forces and torque to the drilling string 320. During the back-reaming process the coupler 100 is in the extended position $P_{114}$ such that the coupler 100 transmits tension and torque to the drilling string 320.

Figure 2:
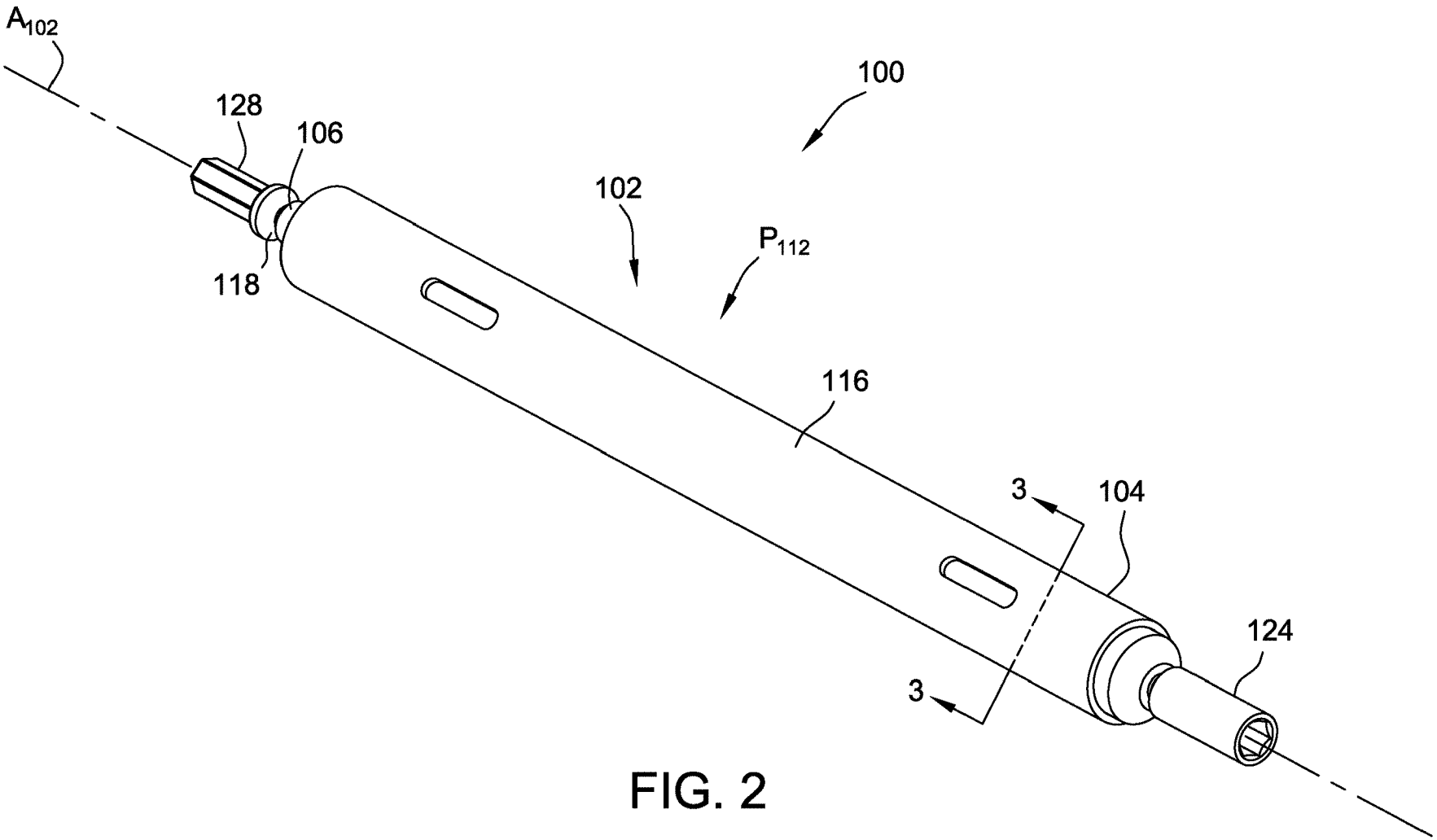
FIG. 2 is a perspective view of the coupler in a retracted position.
Figure 4:
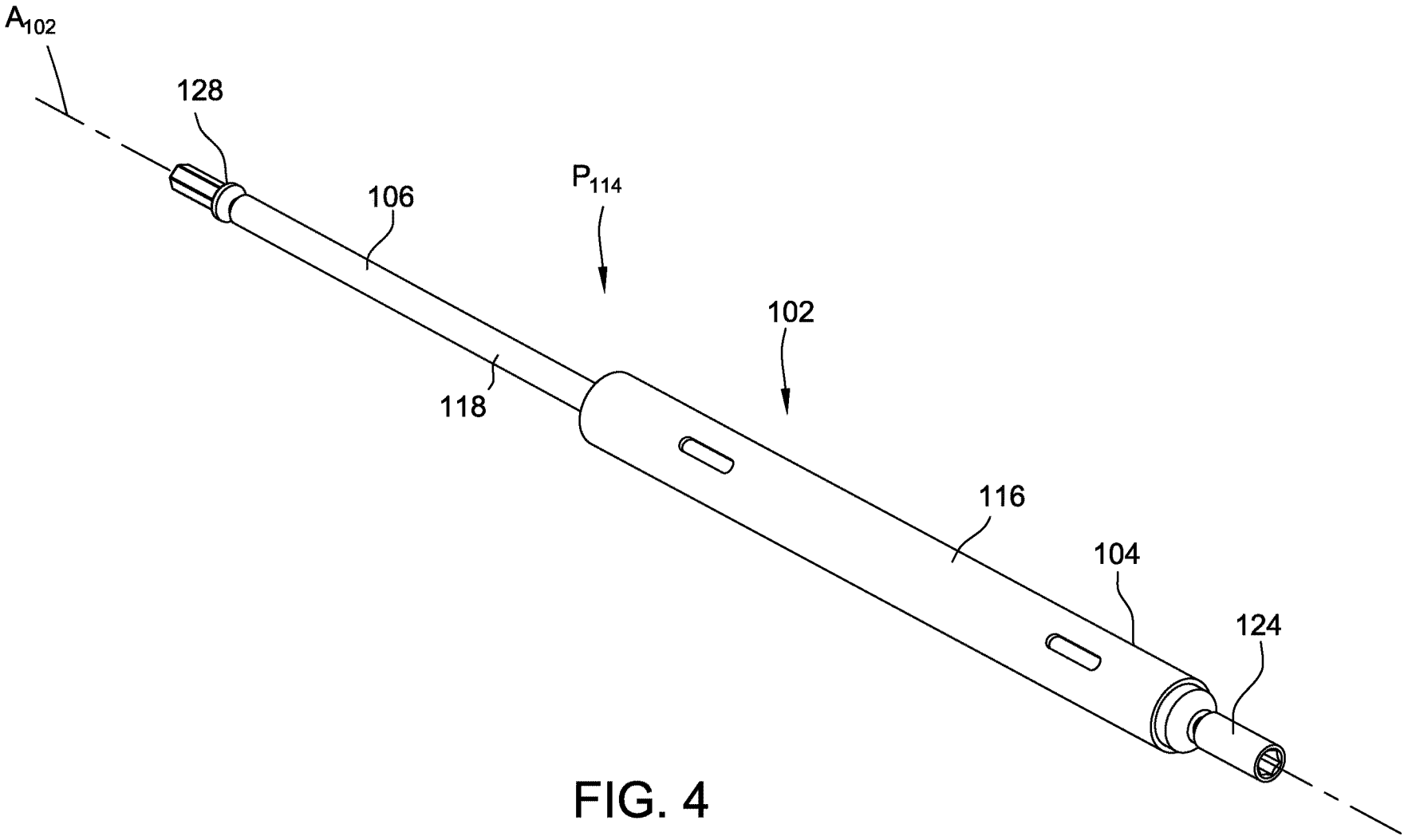
FIG. 4 is a perspective front view of the coupler arranged in an extended position.
Figure 5:
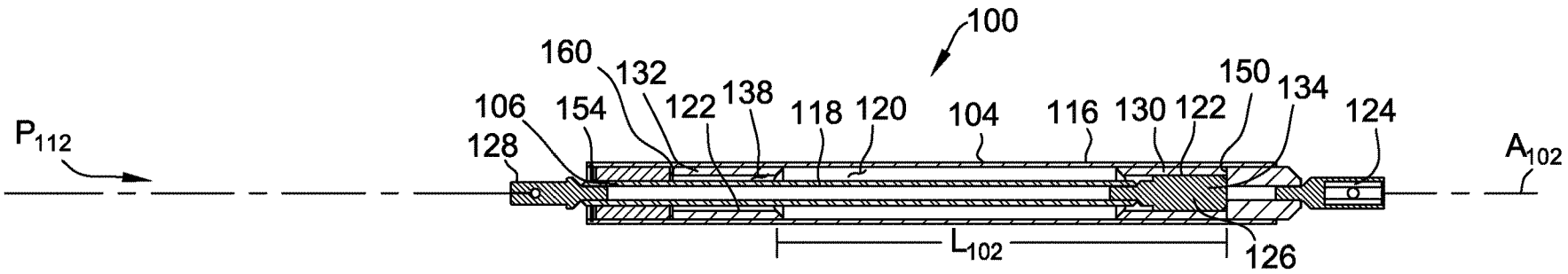
FIG. 5 is a cross-section front view of the coupler in the retracted position.

In accordance with embodiments of the present disclosure, the coupler 100 includes an elongate assembly 102 (FIGS. 2 and 4). The elongate assembly 102 includes a first portion 104 and a second portion 106. The elongate assembly 102 includes an elongate assembly axis $A_{102}$ (also referred to herein as a coupler axis $A_{102}$) that extends through the first portion 104 and the second portion 106. The first portion 104 may be removeably connected to the power source 308 (FIG. 1). The second portion 106 may be removeably connected to a drilling string 320 (FIG. 1).

In the illustrated embodiment, the first portion 104 includes a first shaft 116 (also referred to herein as "outer shaft" in this embodiment) and the second portion 106 includes a second shaft 118 (also referred to herein as "inner shaft" in this embodiment). The first shaft 116 includes a power source connection member 124 for connecting the first shaft 116 to the power source 308. The power source connection member 124 may include components enabling attachment to the power source 308. For example, the power source connection member 124 may be a collar or a keyed opening sized and shaped to receive a portion of the power source 308, such that the power source connection member 124 engages at least a portion of the power source 308. In the illustrated embodiment, the power source connection member 124 is a female connection having an internal hex configuration that mates with a male hex shaft of the power source 308. A fastener such as a pin or key may secure the power source connection member 124 to the power source 308. The power source connection member 124 and power source 308 may have shaped connections other than a hex profile such as square, spline or lemon profiled connections.

The second shaft 118 includes a drilling string connection member 128 for connecting the second shaft 118 to the drilling string 320. The drilling string connection member 128 may include any component which enables the drilling string connection member 128 to attach to the drilling string 320. In the illustrated embodiment, the drilling string connection member 128 is a male hex shaft that mates with a hex opening of the drilling string 320. A fastener such as a pin or key may secure the drilling string connection member 128 to the drilling string 320. The drilling string connection member 128 and drilling string 320 may have shaped connections other than a hex profile such as square, spline or lemon profiled connections.

The first portion 104 and the second portion 106 of the elongate assembly 102 are configured to move relative to each other along the coupler axis $A_{102}$ over a stroke length, $L_{102}$. The stroke length $L_{102}$ extends between a retracted position $P_{112}$ (FIGS. 2 and 5) of the coupler and an extended position $P_{114}$ (FIGS. 4 and 7) of the coupler 100. The coupler 100 includes a first stop 150 that limits axial movement of the inner shaft 118 and the outer shaft 116 relative to each other when the coupler 100 is in the retracted position $P_{112}$ as further described below. The coupler 100 includes a second stop 160 that limits axial movement of the inner shaft 118 and the outer shaft 116 relative to each other when the coupler 100 is in the extended position $P_{114}$ as further described below.

The outer shaft 116 defines an outer shaft chamber 120 disposed within the outer shaft 116. The inner shaft 118 moves within the chamber 120 over the stroke length $L_{102}$. As such, the inner shaft 118 may move further into the chamber 120 of the outer shaft 116 to arrange the coupler 100 in the retracted position $P_{112}$. Additionally, the inner shaft 118 may move further outward from the chamber 120 of the outer shaft 116 to arrange the coupler 100 in the extended position $P_{114}$. At least a portion of the inner shaft 118 is disposed within at least a portion of the chamber 120 of the outer shaft 116. The chamber 120 is disposed between two socket members 130, 132 which receive a portion of the inner shaft 118 as further described below.

The coupler 100 is moveable to one or more intermediate positions $P_{113}$ (FIG. 6) that are between the retracted position $P_{112}$ and the extended position $P_{114}$. The one or more intermediate position $P_{113}$ are within a free stroke length $F_{102}$ in which the first portion 104 and the second portion 106 are able to rotate independently relative to each other about the coupler axis $A_{102}$.

The first portion 104 and/or the second portion 106 may be moved such that the coupler 100 may be arranged into at least one of the retracted position $P_{112}$, extended position $P_{114}$, and an intermediate position $P_{113}$. For example, the coupler 100 in the retracted position $P_{112}$ may be moved to the extended position $P_{114}$ by moving at least one of the first portion 104 and second portion 106 away from each other along the axis $A_{102}$ through the one or more intermediate positions $P_{113}$ and until the inner shaft 118 contacts the second stop 160. Likewise, the coupler 100 may be moved from the extended position $P_{114}$ to the retracted position $P_{112}$ by moving at least one of the first portion 104 and the second portion 106 toward each other through the one or more intermediate positions $P_{113}$ until the inner shaft 118 contacts the first stop 150.

In both the collapsed position $P_{112}$ (FIGS. 2 and 5) and the extended position $P_{114}$ (FIGS. 4 and 7) the coupler 100 is able to transmit torques between the first portion 104 and the second portion 106. The outer shaft 116 of the first portion 104 includes a first outer shaft torque segment 130 and a second outer shaft torque segment 132 spaced apart from each other along the coupler axis $A_{102}$. The first outer shaft torque segment 130 transfers torque in the retracted position $P_{112}$ of the coupler 100 and the second outer shaft torque segment 132 transfers torque in the extended position $P_{114}$ of the coupler 100. The first and second torque segments 130, 132 may be socket members as shown. The socket members 130, 132 may have a hex, square, spline or lemon configuration. The first and second outer shaft torque segments 130, 132 include one or more first shaft torque transferring surfaces 122 (also referred to herein as "outer shaft torque transferring surfaces") for transmitting torques to the second shaft 118.

Figure 3:
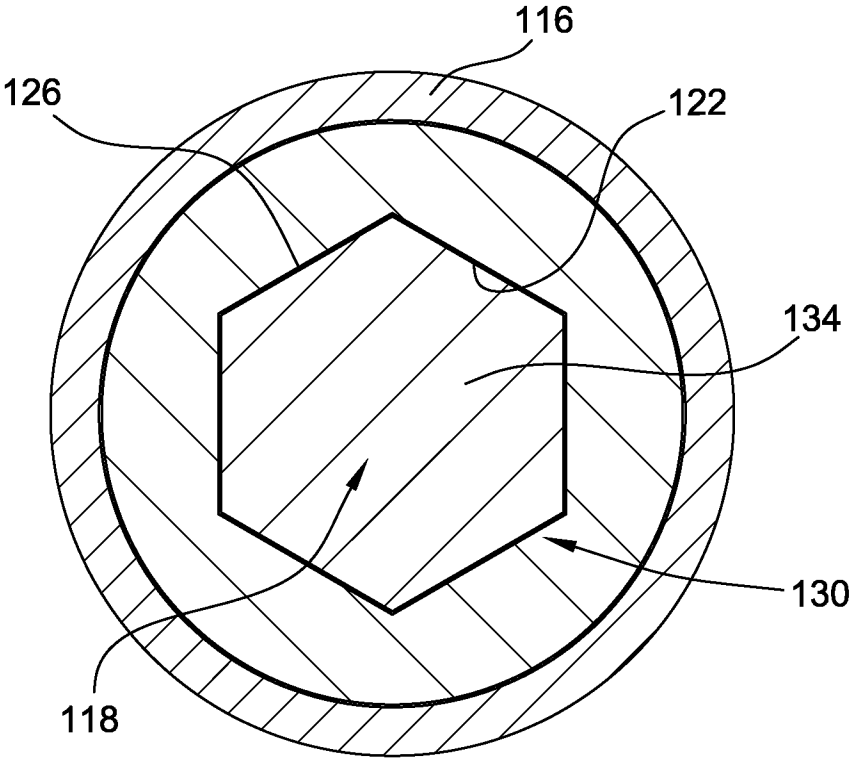
FIG. 3 is a cross-section side view taken along line 3-3 of FIG. 2.
Figure 7:
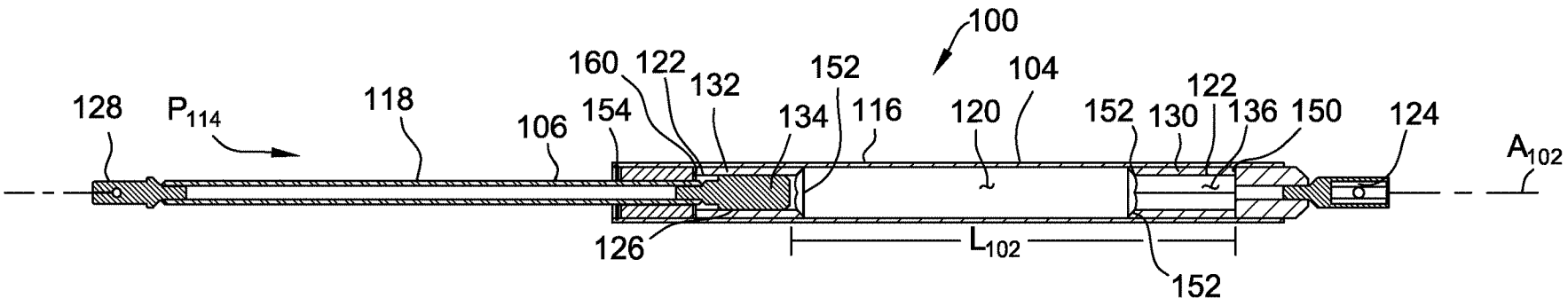
FIG. 7 is a cross-section front view of the coupler in the extended position.
Figure 8:
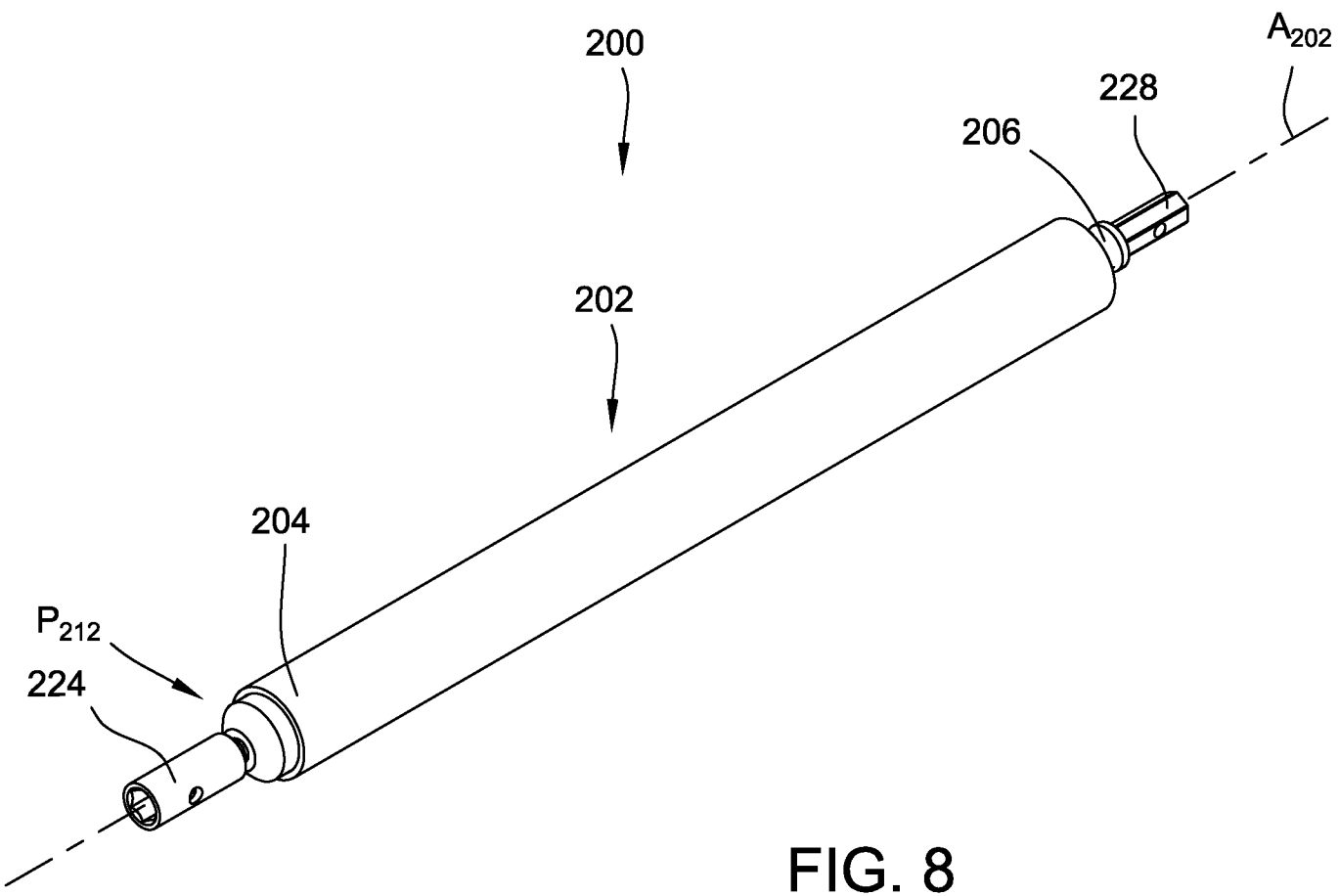
FIG. 8 is a perspective view of another example embodiment of a coupler in the retracted position.
Figure 9:
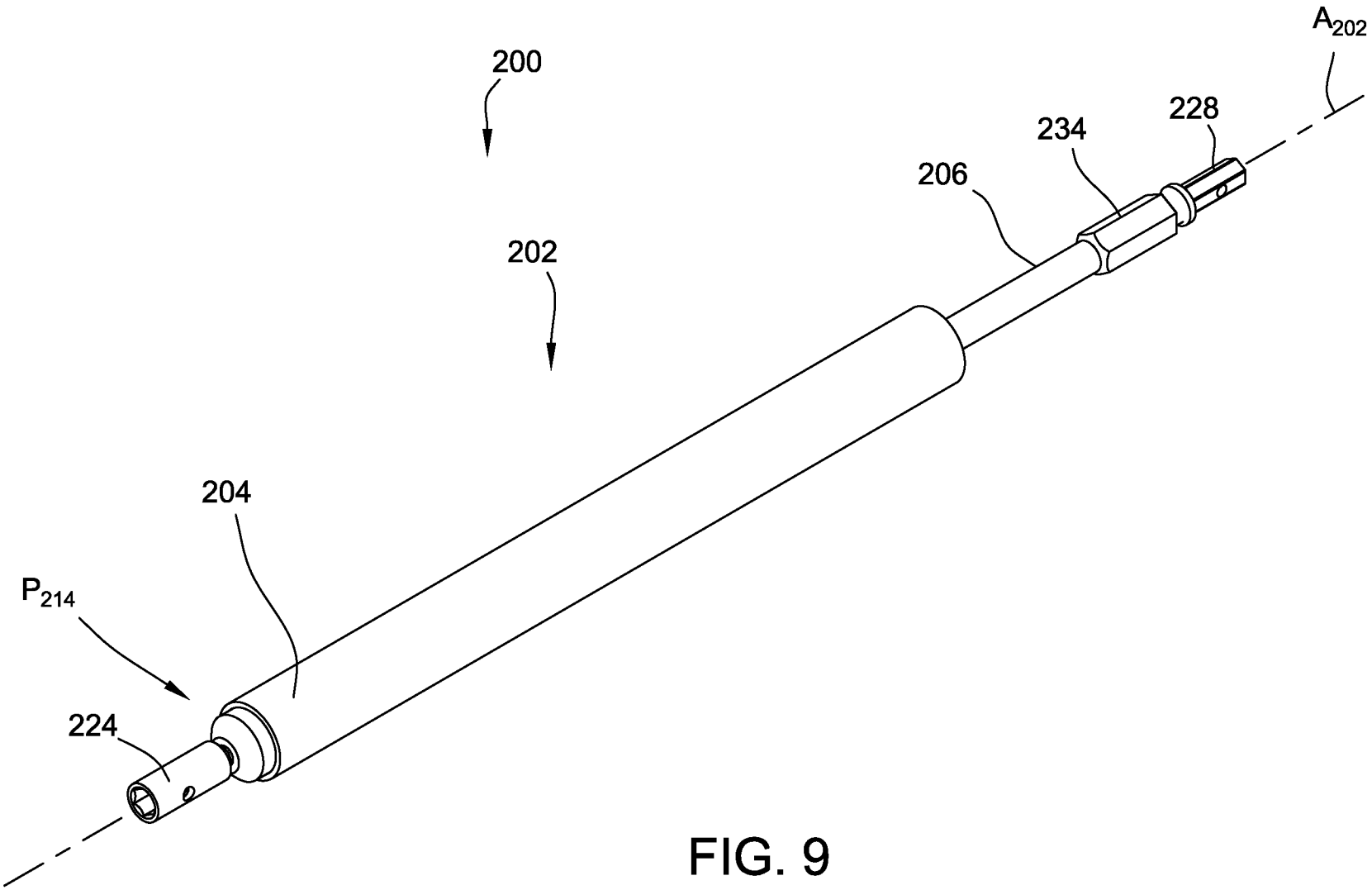
FIG. 9 is a perspective view of the coupler in an extended position.
Figure 10:
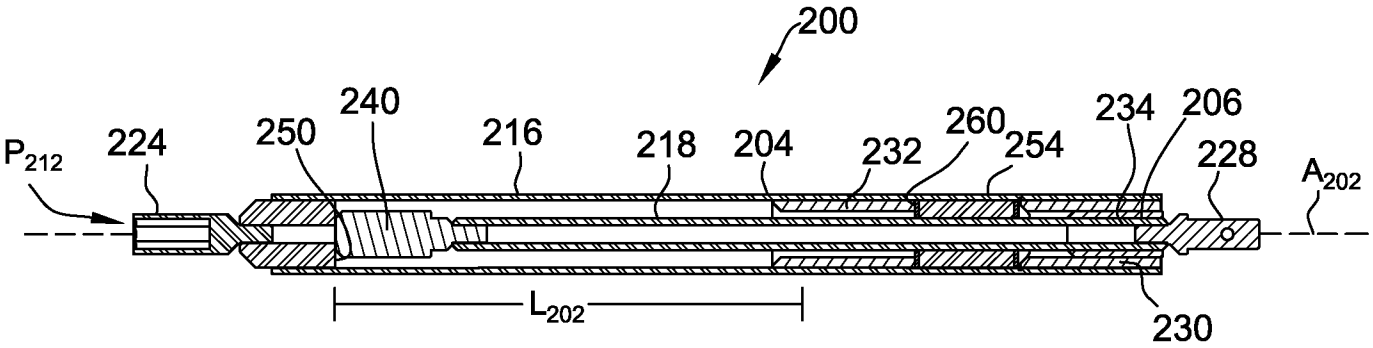
FIG. 10 is a cross-section front view of the coupler in a retracted position.

The inner shaft 118 of the second portion 106 of the elongate assembly 102 includes an inner shaft torque segment 134 which is shown as a shank. The inner shaft torque segment 134 is configured to be selectively received in the first socket member 130 (FIG. 5) or the second socket member 132 (FIG. 7). The inner shaft torque segment 134 has a shape that corresponds to the shape of the socket members 130, 132 (e.g., hex, square, spline or lemon). As shown in FIG. 3, the inner shaft torque segment 134 includes one or more second shaft torque transferring surfaces 126 (also referred to herein as "inner shaft torque transferring surfaces") which engage with the outer shaft torque transferring surfaces 122 to transmit torques. The inner shaft torque transferring surfaces 126 and outer shaft torque transferring surfaces 122 are sized and shaped to prevent the surfaces from moving relative to each other (e.g., are hex-shaped in the illustrated embodiment) which allows torque to be transferred from the outer shaft 116 to the inner shaft 118.

The inner shaft 118 and outer shaft 116 are movable relative to each other along the coupler axis $A_{102}$ to allow the inner shaft torque transferring surfaces 126 to selectively contact (1) the one or more outer shaft torque transferring surface 122 of the first outer shaft torque segment 130 or (2) the one or more outer shaft torque transferring surfaces 122 of the second outer shaft torque segment 132. In this manner the coupler 100 is able to transmit torques between the first portion 104 and the second portion 106 in both the collapsed position $P_{112}$ (FIGS. 2 and 5) and the extended position $P_{114}$ (FIGS. 4 and 7).

The first outer shaft torque segment 130 and the second outer shaft torque segment 132 are separated by the outer shaft chamber 120 through which the inner shaft torque segment 134 moves. The outer shaft chamber 120 may be cylindrical in shape. The inner shaft 118 translates within the outer shaft chamber 120 such that the inner shaft torque transferring surfaces 126 may be selectively in contact with the outer shaft torque transferring surface 122 of either the first outer shaft torque segment 130 or the second outer shaft torque segment 132. The inner shaft 118 is capable of rotating relative to the outer shaft 116 when the inner shaft torque segment 134 is fully within the chamber 120 (i.e., when the coupler 100 is in the one or more intermediate positions $P_{113}$).

In the illustrated embodiment, the inner shaft torque segment 134 is a shank. The first outer shaft torque segment 130 is a first socket member for receiving the inner shaft torque segment 134 and the second outer shaft torque segment 132 is a second socket member for receiving the inner shaft torque segment 134. The first socket member 130 includes a tapered opening surface 152 (FIG. 7) to guide the inner shaft torque segment 134 into the first socket member 130 and the second socket member 132 includes a tapered opening surface 152 to guide the inner shaft torque segment 134 into the second socket member 132.

In the embodiment illustrated in FIGS. 1-7, the first socket member 130 includes a first socket member chamber 136 (FIG. 7) for receiving the inner shaft torque segment 134 and the second socket member 132 includes a second socket member chamber 138 (FIG. 5) from receiving the inner shaft torque segment 134. The first socket member chamber 136 and the second socket member chamber 138 are sized and shaped to mate with the inner shaft torque segment 134.

The first socket member 130, second socket member 132 and inner shaft torque segment 134 (e.g., shank) may be any shape that enables the socket members 130, 132 to transmit torque to the inner shaft torque segment 134. The inner shaft torque segment 134 may be sized and shape to fit within the first and the second socket chambers 136, 138, such that the first portion 104 and the second portion 106 of the elongate assembly 102 are rotationally engaged. In the illustrated embodiment, the first socket member chamber 136 and second socket member chamber 138 are hexagonal in shape and the inner shaft torque segment 134 is shaped hexagonally to mate within either the first socket member chamber 136 or the second socket member chamber 138. When the inner shaft torque segment 134 is disposed within either the first or second socket member chambers 136, 138, the first portion 104 and second portion 106 are rotationally engaged, i.e., the first portion 104 may transmit torques to the second portion 106 or the second portion 106 may transmit torques to the first portion 104 and thereby transmit rotation from the power source 308 to the drilling string 320.

As noted above, the first and second stops 150, 160 of the coupler 100 limit axial movement of the inner shaft 118 and the outer shaft 116 relative to each other. The first stop 150 prevents further retraction of the coupler 100 when the inner shaft torque segment 134 contacts the first stop 150 (i.e., when the coupler 100 is in the retracted position $P_{112}$ (FIG. 5)). The second stop 160 prevents further extension of the coupler 100 when the inner shaft torque segment 134 contacts the second stop 160 (i.e., when the coupler 100 is in the extended position $P_{114}$ (FIG. 7)). Each stop 150, 160 is a shoulder of the outer shaft 116 that engages with a portion of the inner shaft 118 to restrict movement of the inner shaft 118 relative to the outer shaft 116. In other example embodiments, the first and second stops 150, 160 may be a pin that engages both the inner shaft 118 and the outer shaft 116 such that the pin restricts the relative motion between the outer shaft 116 and the inner shaft 118.

In the retracted position $P_{112}$ (FIG. 5) the coupler 100 is able to transfer a compressive force from the first portion 104 to the second portion 106 of the elongate assembly 102. A compressive force applied by the power source 308 (FIG. 1) is transferred to the power source connection member 124 and to the inner shaft torque segment 134 which is contact with the first stop 150. This compressive force is then transferred to the drilling string 320 through the drilling string connection member 128.

In the extended position $P_{114}$ (FIG. 7) the coupler 100 is able to transfer a tensile force from the first portion 104 to the second portion 106. A tensile force applied by the power source 308 (FIG. 1) is transferred to the power source connection member 124 and to the inner shaft torque segment 134 which is in contact with the second stop 160. This tensile force is then transferred to the drilling string 320 through the drilling string connection member 128.

The coupler 100 includes one or more bearings 154. The second shaft 118 is received in the one or more bearings 154 to enable the first shaft 116 and the second shaft 118 to move rotationally when the coupler 100 is in the one or more intermediate positions $P_{113}$ (FIG. 6) and to move axially relative to each other such as when the coupler is being moved between one or more of the retracted position (FIG. 4), intermediate position $P_{113}$ (FIG. 6) and the extended position $P_{114}$ (FIG. 7).

Figure 11:
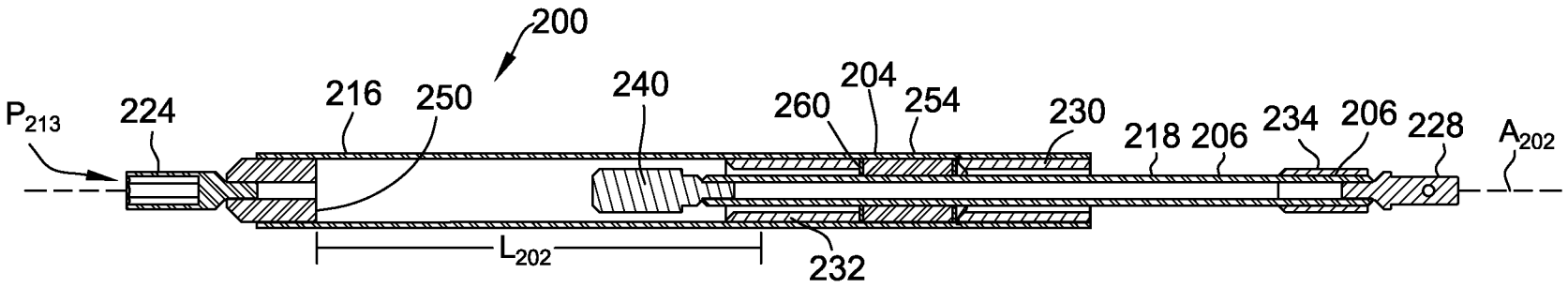
FIG. 11 is a cross-section front view of the coupler in an intermediate position.
Figure 12:
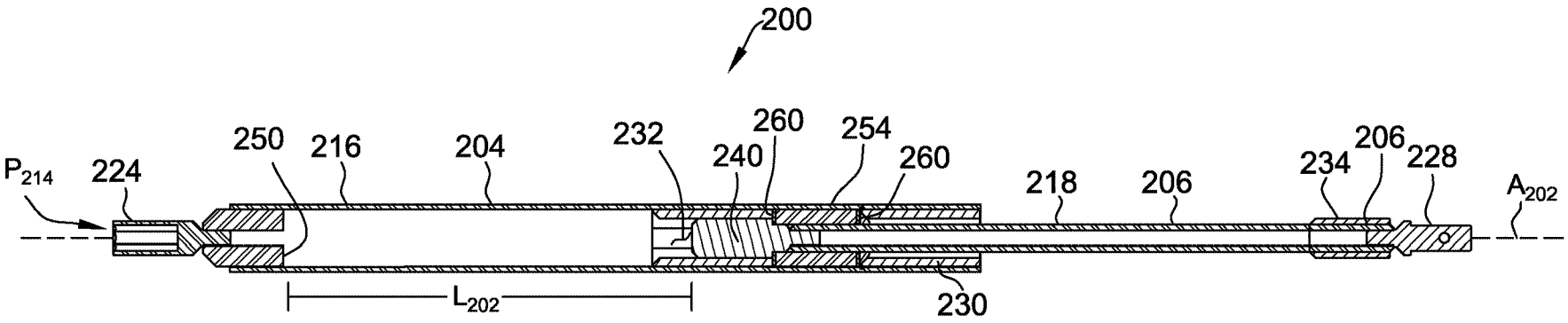
FIG. 12 is a cross-section front view of the coupler in the extended position.

Another embodiment of a coupler 200 for transmitting a torque and a force to a drilling string is shown in FIGS. 8-12. It should be noted that the coupler components shown in FIGS. 8-12 that are analogous to those of FIGS. 1-7 are designated by the corresponding reference number of FIGS. 1-7 plus "100" (e.g., part 116 becomes part 216). The coupler 200 may be arranged in at least one of the retracted position $P_{212}$ (FIGS. 8 and 10), the extended position $P_{214}$ (FIGS. 9 and 12), and the one or more intermediate positions $P_{213}$ (FIG. 11). The coupler 200 includes an inner shaft 218 that moves within an outer shaft 216. The inner shaft 218 includes a first inner shaft torque segment 234 and a second inner shaft torque segment 240. The outer shaft 216 includes a first outer shaft torque segment 230 and a second outer shaft torque segment 232 further described below.

The first inner shaft torque segment 234 is a first shank and the second inner shaft torque 240 segment is a second shank. The first outer shaft torque segment 230 is a first socket member that receives the first shank 234. The second outer shaft torque segment 232 is a second socket member that receives the second shank 240. In the extended position $P_{214}$ (FIG. 12), the second shank 240 is disposed within the second socket member 232, such that the first shaft 216 may transmit a tensile force and a torque to the second shaft 218. In the retracted position $P_{212}$ (FIG. 10), the first shank 234 is disposed within the first socket member 230 and the first shaft 216 is capable of transmitting a compressive force and a torque to the second shaft 218.

Compared to conventional couplers, couplers of embodiments of the present disclosure have several advantages. The coupler allows the power source (e.g., drill) to be more easily connected to the drilling string. A single operator may easily adjust the length of the coupler. For example, an operator may manually move at least one of the first portion or the second portion of the coupler to allow the coupler length to be adjusted to connect to the drilling string and the power source. The operator may rotate either the first portion or the second portion to properly index the power source connection member with the power source (or the drilling string if the power source was connected first). In addition, the stroke length allows the operator to adjust the overall length of the coupler to aid the operator in connecting the coupler between the drilling string and the power source. The adjustable length of the coupler and the ability to rotate the first and second portions of the coupler relative to each other to index the power source to the drilling string are particularly advantageous when multiple drill string members (e.g., rods) are added or removed from the drilling string during a drilling operation.

The self-propelled machine may be used to position the power source in proximity to the drilling string and then the operator may adjust the length of the coupler in order to connect the coupler to the drilling string and the power source. If the coupler is connected in at least one of the intermediate positions, then the self-propelled machine may be used to position the coupler in either the extended or retracted position. For example, if a back-reaming operation is performed (i.e., tensile force is applied to the drilling string), the self-propelled machine moves the coupler from the intermediate position to the extended position such that the coupler transmits a tensile force to the drilling string. Likewise, if a forward drilling operation is performed (i.e., compressive force is applied to the drilling string), the self-propelled machine moves the coupler from the intermediate position to the retracted position such that the coupler transmits a compressive force to the drilling string.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example and without limitation, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A method for coupling a power source to a drilling string, the method comprising:

providing an elongate coupler assembly having a first portion, a second portion, and a coupler axis passing through the first portion and the second portion, the first portion being configured to removeably connect to a power source, the second portion being configured to removeably connect to a drilling string, the first portion and the second portion being configured to move relative to each other along the coupler axis over a stroke length, the stroke length extending between:

a retracted position of the coupler in which the first portion and the second portion are constrained from moving toward each other along the coupler axis and wherein the coupler is able to transfer a compressive force and transmit torque from the first portion to the second portion; and an extended position of the coupler in which the first portion and the second portion are constrained from moving away from each other along the coupler axis and wherein the coupler is able to transfer a tensile force and transmit torque from the first portion to the second portion; and manually moving the coupler to an intermediate position between the retracted position and the extended position to index the first portion or the second portion with the power source or drilling string while connecting the coupler between the drilling string and the power source, the first portion and the second portion being able to rotate independently relative to each other about the coupler axis in the intermediate position.

2. The method as set forth in claim 1 wherein the first portion includes a first shaft and the second portion includes a second shaft, the first shaft having a chamber formed therein, the second shaft moving within the chamber over the stroke length.

3. The method as set forth in claim 1 wherein the first portion includes a first shaft, the first shaft comprising:

one or more first shaft torque transferring surfaces for transferring torque to the second portion; and a power source connection member for connecting the first shaft to the power source.

4. The method as set forth in claim 1 wherein the second portion includes a second shaft, the second shaft comprising:

one or more second shaft torque transferring surfaces for transferring torque from the second portion; and a drilling string connection member for connecting the second shaft to the drilling string.

5. The method as set forth in claim 1 wherein the first portion includes first and second socket members that are spaced from each other along the coupler axis and wherein the second portion includes a shank configured to be received in the first and second socket members.

6. The method as set forth in claim 5 wherein the first portion includes a first shaft and the second portion includes a second shaft.

7. The method as set forth in claim 5 wherein the first socket member includes a first socket member chamber for receiving the shank and the second socket member includes a second socket member chamber for receiving the shank, the first socket member chamber and the second socket member chamber being sized and shaped to mate with the shank.

8. The method as set forth in claim 1 wherein the second portion includes a first shank and a second shank that are spaced from each other along the coupler axis and wherein the first portion includes a first socket member configured to receive the first shank and a second socket member configured to receive the second shank.

9. The method as set forth in claim 8 wherein the first portion includes a first shaft and the second portion includes a second shaft.

10. The method as set forth in claim 8 wherein the first socket member includes a first socket member chamber for receiving the first shank, the first socket member chamber being sized and shaped to mate with the first shank, the second socket member including a second socket member chamber for receiving the second shank, the second socket member chamber being sized and shaped to mate with the second shank.

11. The method as set forth in claim 1 wherein the first portion includes a first shaft and the second portion includes a second shaft, the coupler comprising one or more bearings, the second shaft being received in the one or more bearings to enable the first and second shafts to move relative to each other.

* * * * *